United States Patent [19]

Sieffert

[11] 4,313,555

[45] Feb. 2, 1982

[54] CORNER LOCK CARTON

[75] Inventor: William G. Sieffert, Joliet, Ill.

[73] Assignee: Champion International Corporation, Stamford, Conn.

[21] Appl. No.: 159,454

[22] Filed: Jun. 16, 1980

[51] Int. Cl.[3] ..... B65D 5/26

[52] U.S. Cl. ..... 229/35

[58] Field of Search ..... 229/35

[56] References Cited

U.S. PATENT DOCUMENTS

| | | | |
|---|---|---|---|
| 186,459 | 1/1877 | Buckingham | 229/35 |
| 242,365 | 5/1881 | Pratt et al. | 229/35 |
| 1,955,663 | 4/1934 | Wendell et al. | 229/35 X |
| 2,304,362 | 12/1942 | Huye | 229/35 |
| 3,010,636 | 11/1961 | Vanderlugt, Jr. | 229/35 |
| 3,708,103 | 1/1973 | Evans | 229/35 |

FOREIGN PATENT DOCUMENTS

| | | | |
|---|---|---|---|
| 170263 | 5/1906 | Fed. Rep. of Germany | 229/35 |

*Primary Examiner*—Herbert F. Ross

*Attorney, Agent, or Firm*—Evelyn M. Sommer

[57] ABSTRACT

A carton having a bottom tray and cover element. Opposite corners of both the tray and cover element include a locking flap assembly which is part of the adjacent sidewalls of each element, and is used to assemble the tray and cover. The locking flap assemblies include a hook cut in a sidewall flap extension received within a slot cut in an adjacent sidewall.

6 Claims, 8 Drawing Figures

Fig. 1.
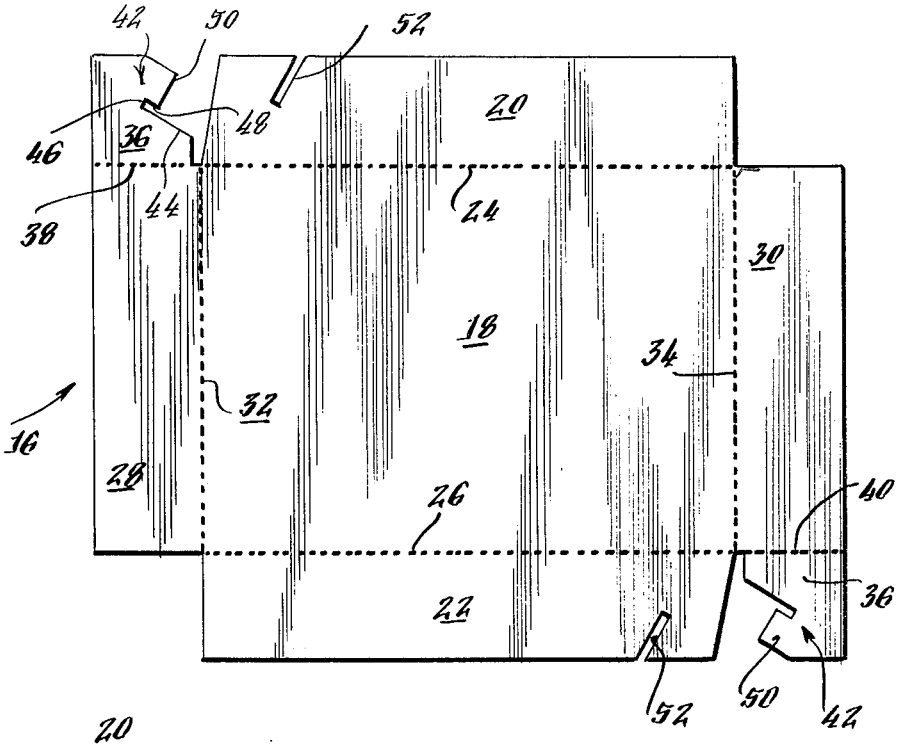
Fig. 2.
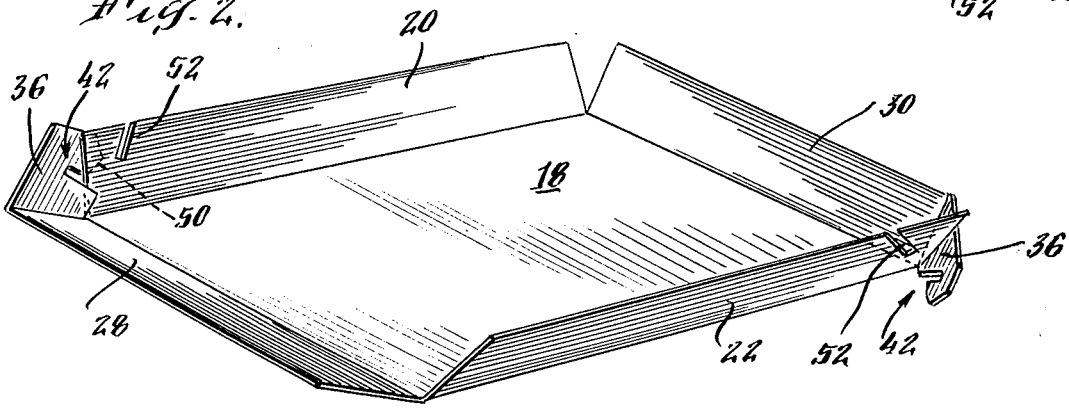
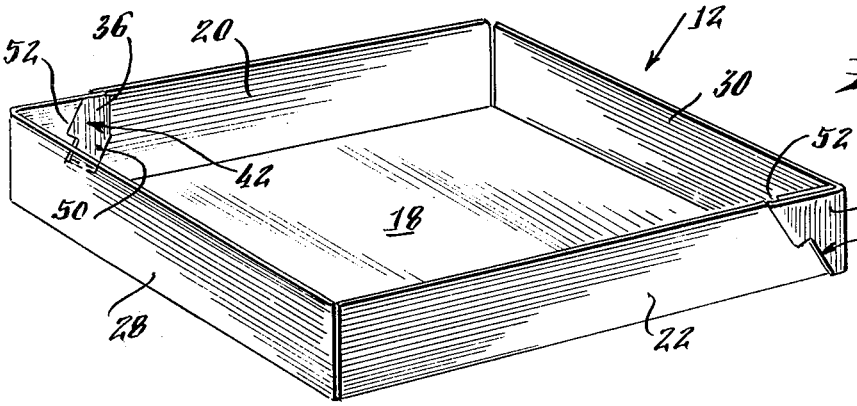
Fig. 3.
Fig. 4.
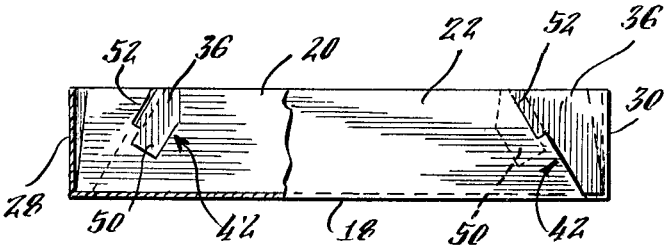

Fig. 5.
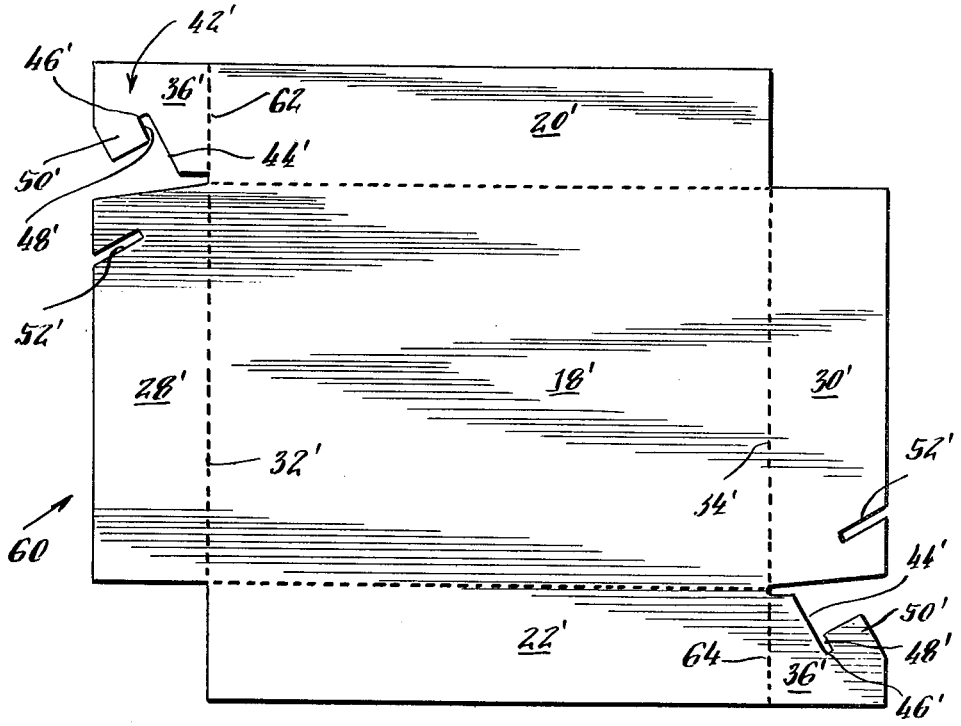
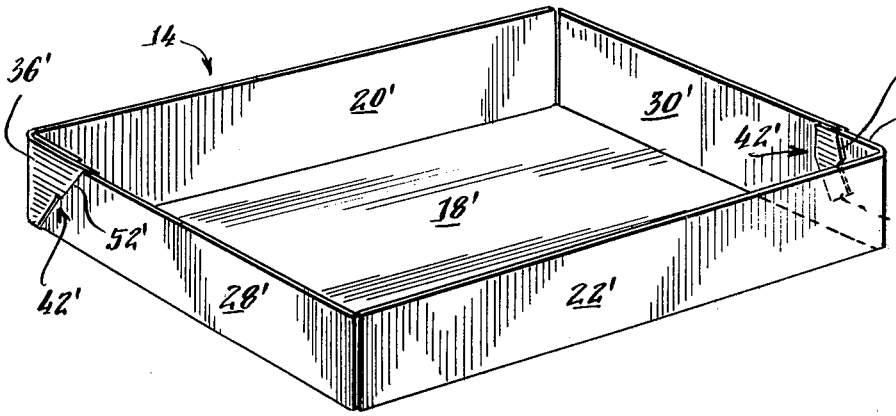
Fig. 6.
Fig. 7.
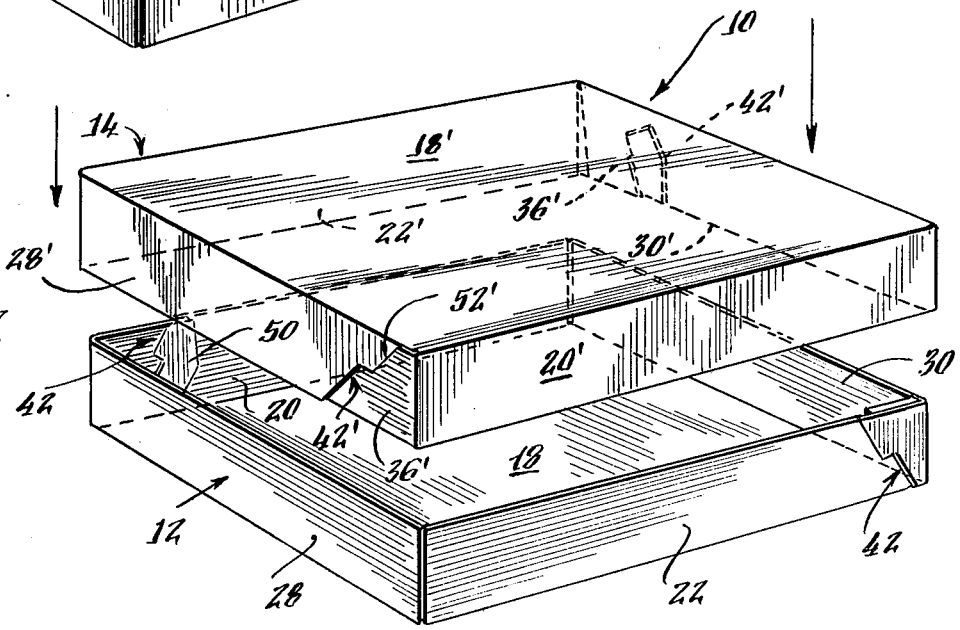

CORNER LOCK CARTON

BACKGROUND OF THE INVENTION

This invention relates to a carton construction and more particularly, a carton construction provided with a die-cut corner lock assembly.

Conventional two-piece carton constructions comprising a bottom tray portion and a cover element are usually formed by folding both the tray and cover about score lines and overlapping flaps secured to the sidewalls of the folded tray and cover. The flaps are secured together by the use of adhesive or staples, which is both time consuming and requires additional materials.

Accordingly, it has been proposed in the prior art to provide integral tabs on flaps at the corners of the trays and covers so that the flaps can be interleaved to lock the erected sidewalls in an assembled condition. Usually, such trays and covers necessitate utilization of additional flaps than normally would be provided on a conventional scored tray and/or cover element.

The corner lock assembly utilized in the tray and cover elements of the carton construction of the present invention require no more material than would be utilized in conventionally scored trays and/or covers and enables the carton construction to be erected and assembled quickly and efficiently without glue or staples.

SUMMARY OF THE INVENTION

In accordance with the present invention, a die-cut corner lock is provided on diagonally opposite corners of a tray and cover element of a carton construction. The corner lock construction includes a tab comprising a flap extension on one of the sidewalls of the tray and cover having a hook-like element die-cut at an angle of approximately 30° to a horizontal or vertical score line. An adjacent sidewall has a slot cut therein at a complemental angle, or at 60°, to the score line. Upon assembly of the tray or cover element, the hook-like element is received within the slot to lock adjacent sidewalls of the tray and/or cover together in an upright condition. The hook-like member formed on the flap extension interleaved with the slot on the adjacent sidewall resists separation of the sidewalls.

The remaining diagonal corners of the cover and/or tray are devoid of interlocking flap assemblies to further effect cost savings of materials. It is only necessary to assemble the tray portion and cover element with opposite diagonal corners which are interlocked adjacent the corner void of such interlocking flaps on the other element so that each of the four corners of the composite carton construction including the tray and cover have four interlocked corners which precludes separation of the carton elements and retains the structural integrity of the composite carton.

BRIEF DESCRIPTION OF THE DRAWINGS

Further objects and advantages of the present invention will become apparent from the following description and claims and from the accompanying drawings, wherein:

FIG. 1 is a plan view of a blank for forming the tray portion of the carton construction of the present invention;

FIG. 2 is a perspective view illustrating the manner of folding the blank of FIG. 1 to form an erected tray;

FIG. 3 is a perspective view of the erected tray portion of the carton of the present invention;

FIG. 4 is a side view in elevation of the tray of FIG. 3 with portions removed and illustrated in section;

FIG. 5 is a plan view of a blank for forming the cover element of the carton construction of the present invention;

FIG. 6 is a perspective view of the erected cover element of the carton of the present invention;

FIG. 7 is a perspective view of the manner of assembling the tray portion and cover element of FIG. 3 and 6 to form the carton construction of the present invention.

DETAILED DESCRIPTION OF THE PREFERRED EMBODIMENT

Figure 8:
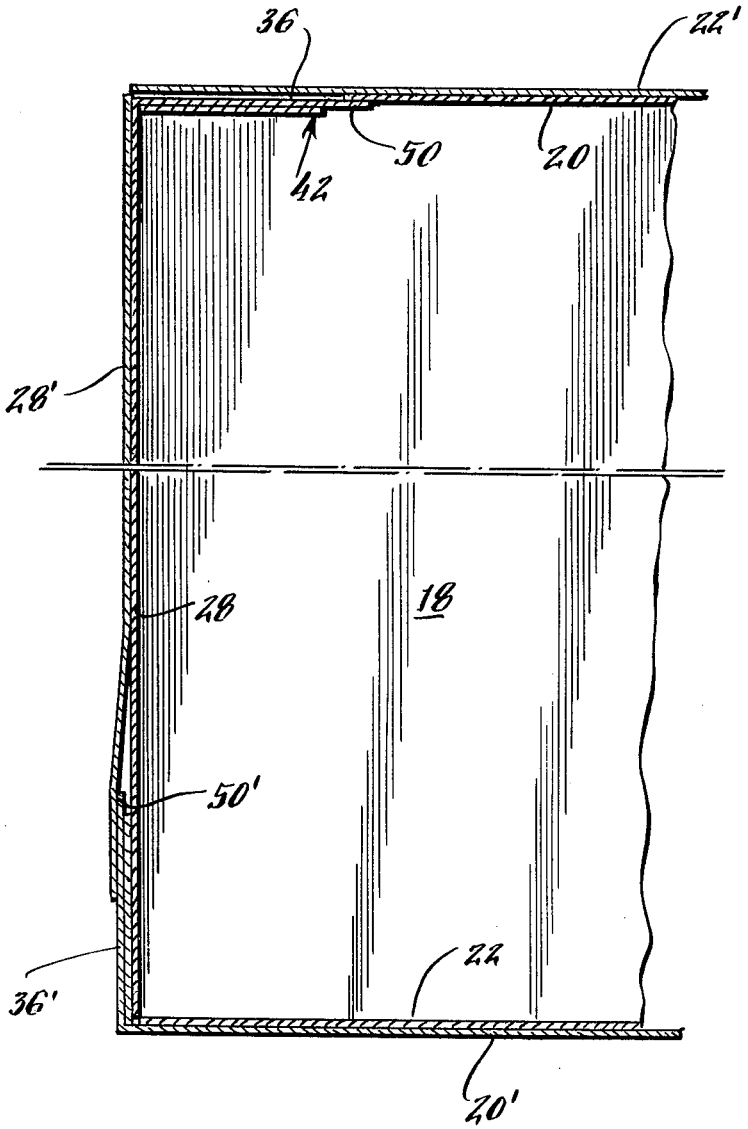
FIG. 8 is a partial, longitudinal, cross-sectional view through the carton construction of FIG. 7.

Referring now in detail to the drawings, wherein like numerals indicate like elements throughout the several views, the carton construction 10 of the present invention includes a bottom tray portion 12 and a cover element generally designated by the numeral 14.

Tray portion 12 is formed from a blank 16. Blank 16 includes a central rectangular panel 18 having an upper and lower sidewall panel 20 and 22, respectively secured thereto along perforated score lines 24 and 26, respectively. Similarly, rectangular sidewall panels 28 and 30 are foldably secured along perforated score lines 32 and 34, respectively, to the remaining side edges of the rectangular central portion 18.

Diagonally opposed corners of blank 16 are provided with a die-cut corner lock assembly for use in erecting the carton blank into a tray element 12 and retaining the same in the erected or assembled condition. The corner lock construction includes a flap 36 foldably connected along a score line 38 and 40, respectively, to the top and bottom edges of side panels 28 and 30, respectively. A hook-like element 42 is cut in each flap 36 by die-cutting a line 44 at an angle of 30° to the horizontal score lines 38 and 40, respectively. A contiguous second cut line 46 extends at an angle of 90° to line 44, a contiguous third line 48 extends parallel to line 44 and perpendicular to line 46, and a fourth line 50 is cut parallel to line 46 and perpendicular to lines 48 and 44. The contiguous, die-cut lines 44, 46, 48, and 50 form the hook-element 42.

An elongated slot 52 is die-cut in the adjacent sidewall 20 and 22 at approximately an angle of 60° to the fold line 24 and 26, respectively, starting from the outer edge of the sidewall 20 and 22.

In erecting the tray 14 from blank 16, sidewall panels 20, 22, 28, and 30 are folded 90° about the respective score lines 24, 26, 32, and 34, respectively. Corner flaps 36 are then folded 90° about their respective perforated score lines 38 and 40 and hook-like element 46 inserted into slot 52 on the adjacent sidewalls 20 and 22, as illustrated in FIGS. 2 and 3. The portion of the hook-like element defined by the upper end of line 44, line 46 and line 48 precludes ready separation of the flap 36 with its associated sidewall 20 or 22, as shown in FIG. 4.

The cover element 14 is formed from a blank 60 of substantially the identical construction as the blank 16 for forming the tray portion 12 of the carton construction 10. Accordingly, primed numerals indicate like elements on the cover element 14 when compared to the tray portion 12 of the carton construction 10.

As will be readily apparent, the cover element blank 60 is substantially identical to that of the tray blank 16, except that the locking tabs 36' are foldably connected by perforated score lines 62 and 64 respectively, to sidewall panels 20' and 22', rather than sidewall panels 28' and 30' as in the tray element blank 16. Slots 52' are formed on sidewalls 28' and 30' rather than sidewalls 20' and 22'. Otherwise the construction and assembly of the blanks 16 and 60 are identical.

With respect to the cover element 14, hook element 42' is inserted in slot 52' to form a corner lock to lock the sidewalls in erected condition extending 90° downwardly from central portion 19' of the cover element (see FIG. 7). Line 44' of each hook element 42' is cut at an angle of 30° with respective to the perforated score lines 62 and 64, while slots 52' are formed at an angle of 60° to the fold lines 32' and 34', respectively.

Once the cover 14 and tray portion 12 of the carton construction 10 are assembled, the cover is disposed on the tray portion so that the unconnected opposite, diagonal, corners of the tray portion are beneath the opposite, diagonal, interlocked corners of the cover element and vice-versa, as shown in FIGS. 7 and 8. This retains the carton construction 10 in its erect and assembled condition, without the use of additional corner lock assemblies on two corners of the carton 10, resulting in additional savings of material and assembly time.

While the hook-like elements 42 and slot 52 have been disclosed for forming a corner lock assembly, the identical elements could be provided on and spaced along one of the sidewalls to form a flap lock, rather than a corner lock in a carton construction.

What is claimed as new is:

1. A carton construction comprising:

a tray having a plurality of upright tray sidewalls;

at least a first of said tray sidewalls having a laterally extending flap provided with a first hook-like member projecting therefrom;

a second of said tray sidewalls, adjacent to said first tray sidewall, having a slot for interleaving engagement with said first hook-like member to lock said first and second tray sidewalls together in an erected state; and a cover having a plurality of upright cover sidewalls;

at least a first of said cover sidewalls having a laterally extending flap provided with a second hook-like member projecting therefrom;

a second of said cover sidewalls, adjacent to said first cover sidewall, having a slot for interleaving engagement with said second hook-like member to lock said first and second cover sidewalls together in an erected state;

said cover being adapted to be received on said tray so that the interlocked corner of said tray is adjacent an unconnected corner of said cover and the interlocked corner of said cover is adjacent an unconnected corner of said tray.

2. The carton of claim 1 wherein said tray and said cover each include a pair of diagonally opposed interlocked corners.

3. The carton construction of claim 1 wherein said laterally extending flaps of said tray and cover sidewalls are joined to their respective sidewalls by a fold line, and said hook-like members are disposed at an acute angle with respect to their respective fold lines.

4. The carton construction of claim 3 wherein said slots on said second tray and cover sidewalls are disposed at an acute angle with respect to the top edge of their respective sidewalls.

5. The carton construction of claim 4 wherein the acute angle of said hook-like members is approximately 30°.

6. The carton construction of claim 5 wherein the acute angle of said slots is approximately 60°.

* * * * *